US008452199B2

(12) United States Patent
Kumagai

(10) Patent No.: US 8,452,199 B2
(45) Date of Patent: May 28, 2013

(54) WASTE TONER COLLECTOR, IMAGE FORMING APPARATUS, AND WASTE TONER COLLECTION CONTAINER

(75) Inventor: Naohiro Kumagai, Machida (JP)

(73) Assignee: Ricoh Company Limited, Tokyo (JP)

( * ) Notice: Subject to any disclaimer, the term of this patent is extended or adjusted under 35 U.S.C. 154(b) by 465 days.

(21) Appl. No.: 12/385,866

(22) Filed: Apr. 22, 2009

(65) Prior Publication Data

US 2009/0263147 A1 Oct. 22, 2009

(30) Foreign Application Priority Data

Apr. 22, 2008 (JP) ..... 2008-111370

(51) Int. Cl.
*G03G 21/12* (2006.01)

(52) U.S. Cl.
CPC ..... *G03G 21/12* (2013.01)
USPC ..... 399/35; 399/120; 399/358

(58) Field of Classification Search
CPC ..... G03G 21/12
USPC ..... 399/35, 123
See application file for complete search history.

(56) References Cited

U.S. PATENT DOCUMENTS

| | | | | |
|---|---|---|---|---|
| 5,909,604 | A | 6/1999 | Arai | |
| 7,403,738 | B2 | 7/2008 | Murakami et al. | |
| 2004/0190918 | A1 | 9/2004 | Park | |
| 2006/0024103 | A1 * | 2/2006 | Murakami et al. | 399/360 |
| 2006/0269305 | A1 | 11/2006 | Murakami et al. | |
| 2007/0065166 | A1 | 3/2007 | Takiguchi et al. | |
| 2007/0196148 | A1 * | 8/2007 | Shishikura | 399/358 |
| 2007/0230976 | A1 * | 10/2007 | Takahashi | 399/35 |
| 2009/0060536 | A1 | 3/2009 | Kumagai | |

FOREIGN PATENT DOCUMENTS

| | | |
|---|---|---|
| CN | 101082803 | 12/2007 |
| JP | 04-338993 | 11/1992 |
| JP | 2000-112304 | 4/2000 |
| JP | 2003-271023 | 9/2003 |
| JP | 2006-085112 | 3/2006 |
| JP | 2006-154411 | 6/2006 |
| JP | 2006154411 A * | 6/2006 |

OTHER PUBLICATIONS

Machine translation of JP 2006154411.*
A European Search Report dated Jul. 7, 2009 issued in corresponding EP Application No. 09156378.3-2209.
Chinese Office Action dated Oct. 12, 2010.
Japanese Office Action dated Jan. 31, 2012 issued in Japanese Application No. 2008-111370.

* cited by examiner

*Primary Examiner* — Walter L Lindsay, Jr.
*Assistant Examiner* — David Bolduc
(74) *Attorney, Agent, or Firm* — Harness, Dickey & Pierce, P.L.C.

(57) ABSTRACT

An image forming apparatus, including an image former forming a toner image on an image bearer; a transferer transferring the toner image onto a recording medium; a cleaner collecting a waste toner remaining on the image bearer after transfer of the toner image; a waste toner collection container accumulating the waste toner therein; a detector detecting whether the container is properly set in the image forming apparatus; and another detector detecting that the container is nearly full of the waste toner, wherein the image forming apparatus further comprises a determiner determining a quantity of the waste toner in the container; another determiner determining whether the container is properly exchanged with a vacant container; and a limiter limiting a printable quantity after the container is detected to be nearly full of the waste toner, based on the another determiner.

9 Claims, 4 Drawing Sheets

WASTE TONER COLLECTOR, IMAGE FORMING APPARATUS, AND WASTE TONER COLLECTION CONTAINER

BACKGROUND OF THE INVENTION

1. Field of the Invention

The present invention relates to a copier, a printer, a facsimile or a multifunctional image forming apparatus including their functions, and more particularly to a waste toner collector and an image forming apparatus, having a waste toner collection container containing a toner produced while toner images are formed and collected by a cleaner.

2. Discussion of the Related Art

Image forming apparatuses having a waste toner collection container such as a waste toner bottle containing a waste toner collected by a cleaner are conventionally known, which are capable of printing a predetermined quantity of images even after the waste toner bottle is detected to be nearly full because it is inconvenient in practical if image forming operation is automatically (forcibly) stopped when the waste toner bottle is full.

Japanese published unexamined application No. 4-338993 discloses an image forming apparatus displaying the number of printable images according to each copy mode and paper size until printing is prohibited after detecting the bottle is full.

Japanese published unexamined application No. 2000-112304 discloses an image forming apparatus calculating a cumulative quantity of a waste toner according to image density or copy mode and precisely detecting a space remaining in a cleaning container to make full use of the space after a detector detects the waste toner is full in the container.

Further, Japanese published unexamined application No. 2006-154411 discloses an image forming apparatus making the number of formable images less than that when it is previously detected that a waste toner bottle is nearly full, when the waste toner bottle is detected to be nearly full again in a specific number of formed images after the waste toner bottle is exchanged.

In case of the Japanese published unexamined applications Nos. 4-338993 and 2000-112304, when the waste toner bottles do not have a detector detecting the time for exchanging the bottle, the waste toner bottle is tapped or shaken to change the accumulation status and detection of full container is cancelled, and the bottle can be used again. Images can be formed after the bottle is used again, but the waste toner can be accumulated in the bottle less than when the first full container is detected because the bottle is nearly full of the accumulated waste toner. When such actions are repeated many times, the accumulating waste toner exceeds the capacity of the bottle, the waste toner not only overflows from the bottle but also damages the waste toner transporter and drivers.

In case of the Japanese published unexamined application No. 2006-154411, when the waste toner bottle is tapped or shaken to evenly accumulate the waste toner therein before the bottle is detected to be nearly full, since the waste toner is previously much in the bottle, the accumulating waste toner probably exceeds the capacity of the bottle when the first formable images have been formed. Therefore, the waste toner is likely to overflow and damage the machine.

Because of these reasons, a need exists for a waste toner collector and an image forming apparatus, capable of identifying whether a waste toner collection container is brand-new or reused after exchanged, and properly preventing the waste toner from overflowing from the container and damaging the apparatus even when using a reused waste toner collection container (used waste toner collection container previously including a waste toner)

SUMMARY OF THE INVENTION

Accordingly, an object of the present invention is to provide a waste toner collector and an image forming apparatus, capable of identifying whether a waste toner collection container is brand-new or reused after exchanged, and properly preventing the waste toner from overflowing from the container and damaging the apparatus even when using a reused waste toner collection container (used waste toner collection container previously including a waste toner).

To achieve such objects, the present invention contemplates the provision of a waste toner collector, comprising:

a cleaner configured to collect a waste toner remaining on an image bearer after transfer onto a recording medium a toner image formed by an image forming apparatus on the image bearer;

a waste toner collection container configured to accumulate the waste toner therein;

a first detector configured to detect whether the waste toner collection container is properly set in the image forming apparatus; and a second detector configured to detect that the waste toner collection container is nearly full of the waste toner, wherein the waste toner collector further comprises:

a first determiner configured to determine a quantity of the waste toner in the waste toner collection container; and a second determiner configured to determine whether the waste toner collection container is properly exchanged with a vacant waste toner collection container.

In another aspect of the present invention, an image forming apparatus is provided, comprising:

an image former configured to form a toner image on an image bearer;

a transferer configured to transfer the toner image onto a recording medium;

a cleaner configured to collect a waste toner remaining on an image bearer after transferred;

a waste toner collection container configured to accumulate the waste toner therein;

a first detector configured to detect whether the waste toner collection container is properly set in the image forming apparatus; and a second detector configured to detect that the waste toner collection container is nearly full of the waste toner, wherein the image forming apparatus further comprises:

a first determiner configured to determine a quantity of the waste toner in the waste toner collection container;

a second determiner configured to determine whether the waste toner collection container is properly exchanged with a vacant waste toner collection container; and a limiter configured to limit a printable quantity after the waste toner collection container is detected to be nearly full of the waste toner, based on the second determiner.

These and other objects, features and advantages of the present invention will become apparent upon consideration of the following description of the preferred embodiments of the present invention taken in conjunction with the accompanying drawings.

DESCRIPTION OF THE PREFERRED EMBODIMENTS

Generally, the present invention provides a waste toner collector and an image forming apparatus, capable of identifying whether a waste toner collection container is brand-new or reused after exchanged, and properly preventing the waste toner from overflowing from the container and damaging the apparatus even when using a reused waste toner collection container (used waste toner collection container previously including a waste toner)

More particularly, the present invention relates to a waste toner collector, comprising:

a cleaner configured to collect a waste toner remaining on an image bearer after transfer onto a recording medium a toner image formed by an image forming apparatus on the image bearer;

a waste toner collection container configured to accumulate the waste toner therein;

a first detector configured to detect whether the waste toner collection container is properly set in the image forming apparatus; and a second detector configured to detect that the waste toner collection container is nearly full of the waste toner, wherein the waste toner collector further comprises:

a first determiner configured to determine a quantity of the waste toner in the waste toner collection container; and a second determiner configured to determine whether the waste toner collection container is properly exchanged with a vacant waste toner collection container.

Furthermore, the present invention relates to an image forming apparatus, comprising:

an image former configured to form a toner image on an image bearer;

a transferer configured to transfer the toner image onto a recording medium;

a cleaner configured to collect a waste toner remaining on an image bearer after transferred;

a waste toner collection container configured to accumulate the waste toner therein;

a first detector configured to detect whether the waste toner collection container is properly set in the image forming apparatus; and a second detector configured to detect that the waste toner collection container is nearly full of the waste toner, wherein the image forming apparatus further comprises:

a first determiner configured to determine a quantity of the waste toner in the waste toner collection container;

a second determiner configured to determine whether the waste toner collection container is properly exchanged with a vacant waste toner collection container; and a limiter configured to limit a printable quantity after the waste toner collection container is detected to be nearly full of the waste toner, based on the second determiner.

First, an embodiment of the image forming apparatus of the present invention will be explained.

Figure 1:
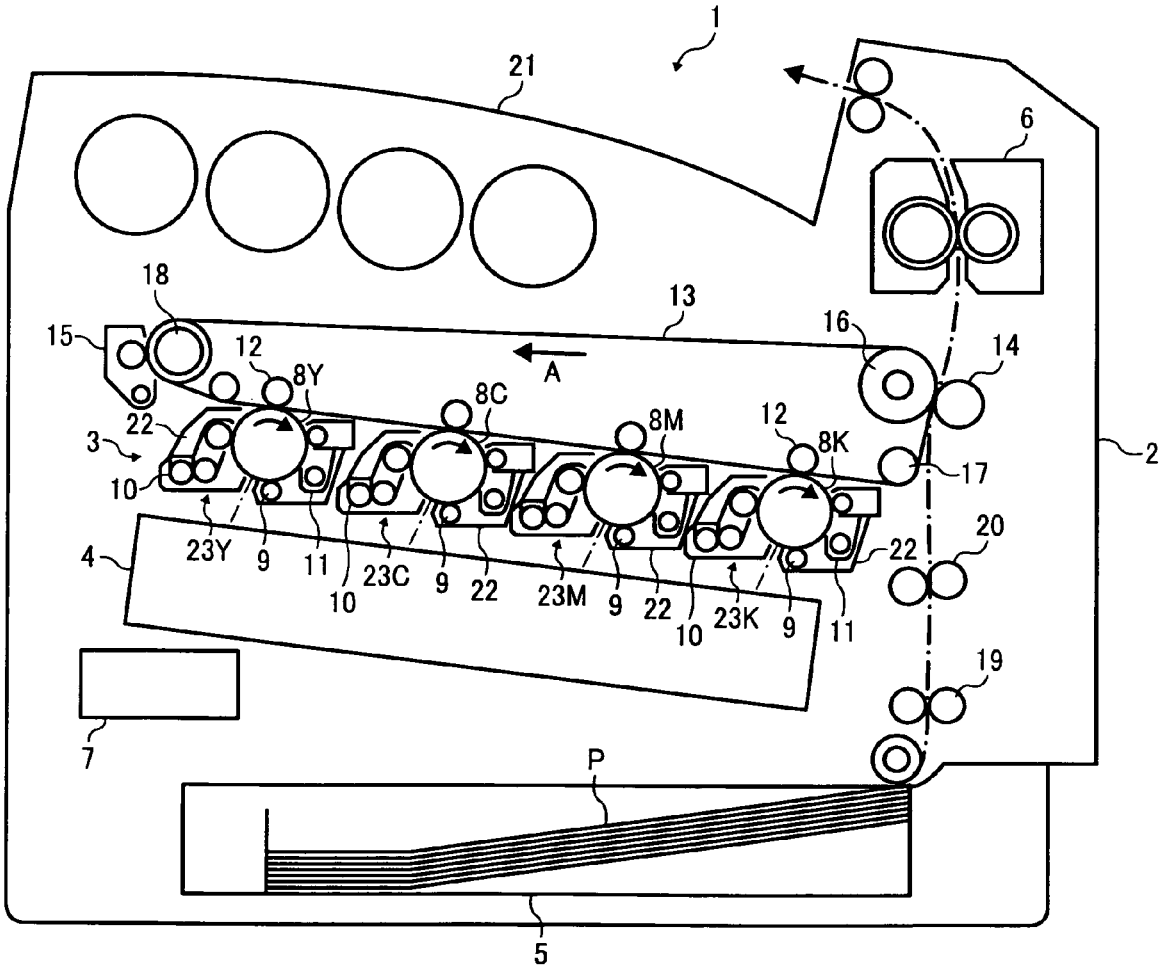
FIG. 1 is a schematic sectional view illustrating an embodiment of the image forming apparatus (color printer) of the present invention.

FIG. 1 is a schematic sectional view illustrating an embodiment of the image forming apparatus (color printer 1) of the present invention, in which four photoreceptors 8 (8Y, 8C, 8M and 8K) and image formers are located along an intermediate transferer 13 in line.

The color printer 1 includes a printer engine 3, an irradiator 4 emitting a writing beam, a paper feed cassette 5 storing a recording medium P, a fixer 6 fixing a toner image on the recording medium P and a waste toner collection container 7 collecting a waste toner after the toner image is transferred in a body case 2.

The printer engine 3 forms a toner image and transfers the toner image onto a recording medium P, and includes four photoreceptors 8Y, 8C, 8M and 8K; charging rollers 9, image developers 10, photoreceptor cleaners 11 cleaning the photoreceptors, first transfer rollers 12 around each of the four photoreceptors 8Y, 8C, 8M and 8K; a belt-shaped intermediate transferer 13, i.e., second image bearer and receiver (hereinafter referred to as an intermediate transfer belt); a second transfer roller 14; and a belt cleaner 15 cleaning the intermediate transfer belt 13; etc.

In the specification and drawings of the present invention, Y, C, M and K represent yellow, cyan, magenta and black colors, respectively. These are used only when necessary and omitted depending on the part.

FIG. 1 is an embodiment of a tandem intermediate transfer method color printer using the intermediate transfer belt 13, and may be a tandem direct transfer method color printer replacing the intermediate transfer belt with a transfer belt transferring the recording medium P to each of the photoreceptors. A scanner, an image processor, etc. can be added to the color printer to from a digital copier, facsimile or a multifunctional machine.

In FIG. 1, each of the photoreceptors 8Y, 8C, 8M and 8K is cylindrically-shaped and connected with a drive motor (not shown) through a gear, etc. to centrally rotate. A photosensitive layer is formed on the circumferential surface of the photoreceptor 8. The charging roller 9 is located contacting the circumferential surface of the photoreceptor 8 or with a small gap therebetween. A voltage is applied to the charging roller 9 from an electrical source (not shown) to generate a corona discharge between the charging roller 9 and the photoreceptor 8, and the circumferential surface of the photoreceptor 8 is uniformly charged.

The irradiator 4 irradiates the uniformly-charged circumferential surface of the photoreceptor 8 with a light beam according to image data to form an electrostatic latent image on the circumferential surface of the photoreceptor 8 according to the image data.

The image developer 10 provides a toner to the photoreceptor 8. The toner adheres to the electrostatic latent image formed on the circumferential surface of the photoreceptor 8 to form a visual toner image.

The intermediate transfer belt 13 is a loop-shaped belt formed of a resin film or rubber substrate, wound around a drive roller 16, an entrance roller 17 and a tension roller 18, and rotates in the direction indicated by an arrow A when the drive roller 16 connected with a drive motor (not shown) is driven to rotate. The entrance roller 17 and the tension roller 18 are driven to rotate by friction with the intermediate transfer belt 13 rotating in the direction indicated by the arrow A.

The first transfer roller 12 is located on the inner circumferential surface of the intermediate transfer belt 13. A transfer voltage is applied to the first transfer roller 12 to transfer a toner image on the photoreceptor 8 onto the intermediate transfer belt 13. The toner image formed on each of the photoreceptors 8 is sequentially overlapped on the intermediate transfer belt 13 to form a full-color toner image thereon.

The photoreceptor cleaner 11 cleans the outer circumferential surface of the photoreceptor. 8 after a toner image is transferred therefrom onto the intermediate transfer belt 13. Then, the toner, a paper dust, etc. remaining on the outer circumferential surface of the photoreceptor 8 are collected as a waste toner.

The full-color toner image formed on the intermediate transfer belt 13 is transferred onto a recording medium P when fed to a contact transfer point between the intermediate transfer belt 13 and the second transfer roller 14 and a transfer voltage is applied thereto. The recording medium P is fed by a feed roller 19 and a registration roller 20 from the paper feed cassette 5 and fed to the fixer 6 after a toner image is transferred onto the recording medium P. The toner image is melted and fixed thereon upon application of heat and pressure in the fixer 6. The recording medium P the toner image is fixed on is discharged onto a paper tray 21 formed on the top of the body case 2.

The belt cleaner 15 cleans the outer circumferential surface of the intermediate transfer belt 13 after a full-color toner image is transferred onto a recording medium P. Then, the toner, a paper dust, etc. remaining on the outer circumferential surface of the intermediate transfer belt 13 are collected as a waste toner.

Waste toners collected by the photoreceptor cleaner 11 and the belt cleaner 15 is placed and accumulated in the waste toner collection container 7. The waste toner collection container 7 is detachable from the body case 2, and taken out therefrom when nearly full of the waste toner to replace the waste toner collection container 7 with a vacant waste toner collection container 7.

The photoreceptor 8, and the charging roller 9, image developer 10 and photoreceptor cleaner 11 around each of the photoreceptors 8 are included in a case 22 as a unit to form a process cartridge 23 (23Y, 23C, 23M and 23K). Each of the process cartridges 23 is detachable from the body case 2. When the photoreceptor 8, charging roller 9, image developer 10 and photoreceptor cleaner 11 are unitized as the process cartridge 23, it is easier to exchange and maintain the members, and which are precisely located to improve image quality. In this embodiment, the process cartridge 23 includes the photoreceptor 8, charging roller 9, image developer 10 and photoreceptor cleaner 11. The process cartridge 23 may include the photoreceptor 8 and at least one of the charging roller 9, image developer 10 and photoreceptor cleaner 11.

Figure 2:
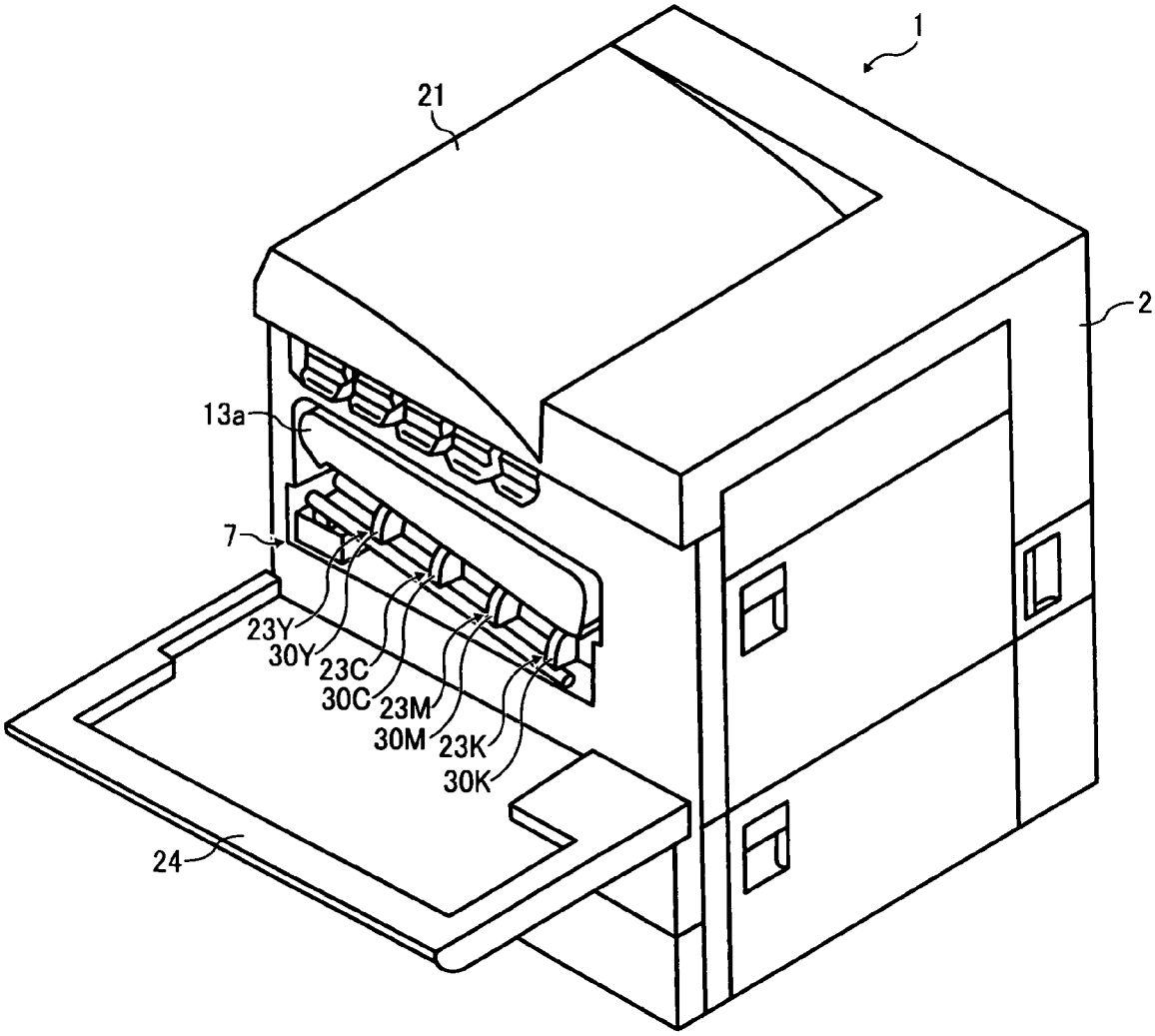
FIG. 2 is a schematic perspective view illustrating the image forming apparatus (color printer) in FIG. 1 with a side cover open.

FIG. 2 is a schematic perspective view illustrating the color printer 1 with a side cover 24 open located on the body case 2.

When the side cover 24 is open, the printer engine 3 and the waste toner collection container 7 appear, and the process cartridge 23, the intermediate transfer belt 13 and the waste toner collection container 7 can be exchanged or maintained. The intermediate transfer belt 13, the rollers 16, 17 and 18, and belt cleaner 15 are included in a belt case 13*a* as a unit.

Figure 3:
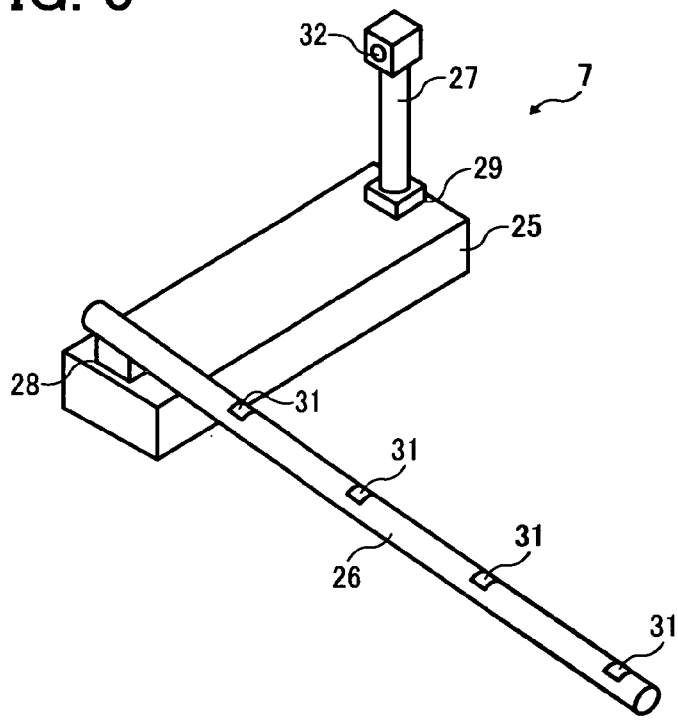
FIG. 3 is a schematic perspective view illustrating an embodiment of a waste toner collection container for use in the image forming apparatus (color printer) in FIG. 1.

FIG. 3 is a schematic perspective view illustrating the waste toner collection container 7.

The waste toner collection container 7 is formed of a container body 25, and waste toner pipes 26 and 27 connected therewith, etc. The container body 25 is a hollow rectangular solid elongated along the detachable direction of the waste toner collection container 7 from the body case 2, and the waste toner pipes 26 and 27 are connected with two slots 28 and 29 formed on tops of the both sides of the container body 25 in the longitudinal direction. The waste toner pipe 26 is for placing the waste toner collected by the photoreceptor cleaner 11 (11Y, 11C, 11M and 11K in FIG. 1) cleaning the photoreceptor 8 into the container body 25. The waste toner pipe 26 has four connection ports 31 discharge sections 30 (30Y, 30C, 30M and 30K in FIG. 2) of the photoreceptor cleaners 11 are connected with. The waste toner pipe 26 includes a conveying screw (not shown) conveying the waste toner discharged from the photoreceptor cleaner 11 to the slot 28. The waste toner pipe 27 is for placing the waste toner collected by the belt cleaner 15 cleaning the intermediate transfer belt 13 into the container body 25. The waste toner pipe 27 has a connection port 32 a discharge section (not shown) of the belt cleaner 15is connected with. The waste toner pipe 27 includes a conveying screw (not shown) conveying the waste toner discharged from the belt cleaner 15 to the slot 29.

Figure 4:
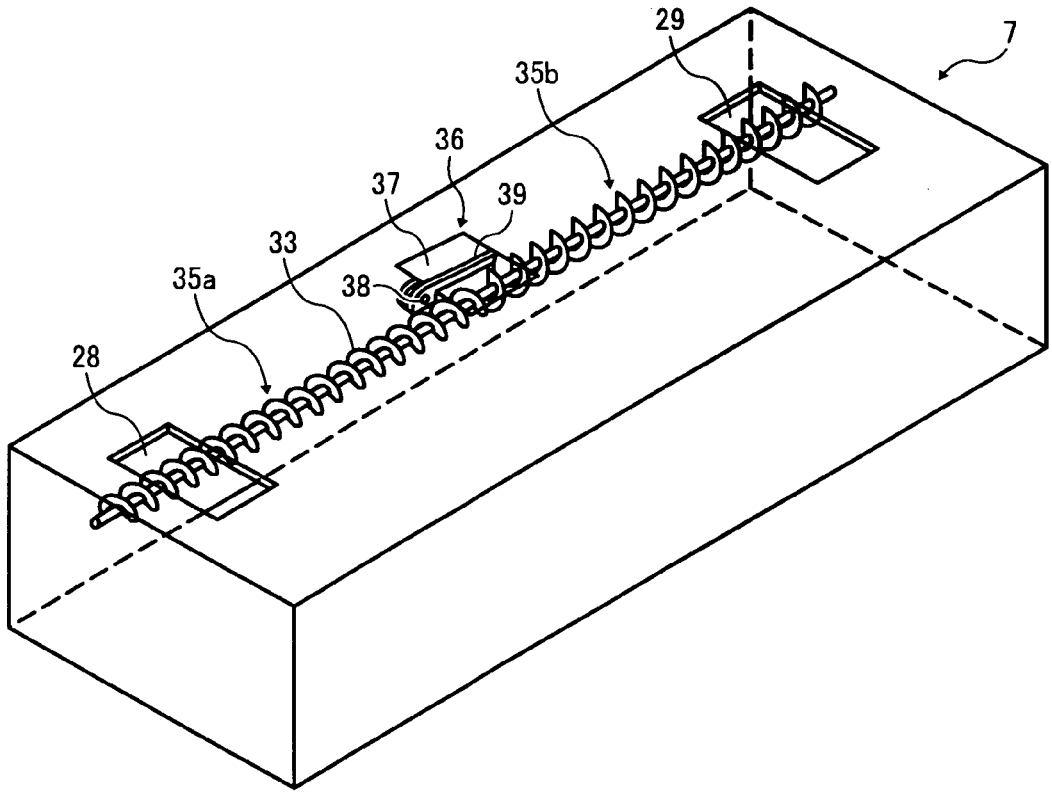
FIG. 4 is a transparent perspective view illustrating the waste toner collection container in FIG. 3.

FIG. 4 is a transparent perspective view illustrating the waste toner collection container 25.

The two slots 28 and 29 are formed on tops of the both sides of the container body 25 in the longitudinal direction, and the waste toner pipes 26 and 27 are connected therewith (FIG. 3) The container body 25 includes a conveying screw 33 elongated in the longitudinal direction (connecting the two slots 28 and 29) of the container body 25 and conveying the waste toner from the slots 28 and 29 in the longitudinal direction, which is centrally rotatable. The conveying screw 33 is located at the upper part in the container body 25, and is driven by s drive motor (not shown) in the body case 2 when the waste toner collection container 7 is installed therein.

The conveying screw 33 has conveying spirals 35*a* and 35*b* from both sides of the screw toward the center thereof. The two conveying spirals 35*a* and 35*b* are formed to convey the waste toner placed from the slots 28 and 29 from both side of the container body 25 toward the center thereof when the conveying screw 33 is driven by a drive motor to rotate. The waste toner placed from the slots 28 and 29 in the container body 25 is accumulated therein until contacting the conveying screw 33, and conveyed from both sides thereof to the center thereof by rotation thereof. When the waste toner in the container body 25 reaches a specific quantity, the waste toner conveyed by the conveying spirals 35*a* and 35*b* by rotation of the conveying screw 33 is pressed against each other and lifted up. The two conveying spirals 35*a* and 35*b* have the same diameter and spiral pitch to have the same conveying capacity, and further have the same size.

On the top surface of the container body 25, a member for detecting the waste toner lifting up when conveyed by the conveying spirals 35*a* and 35*b* of the conveying screw 33 and pressed against each other after the waste toner in the container body 25 reaches a specific quantity, i.e., a detector 36 is located for detecting the container body 25 is nearly full of the waste toner. The detector 36 is attached so as to cover an opening formed on the top surface of the container body 25 and formed of a flexible seal 37 bowing upward by the lifted-up waste toner in the container and a movable chip 39 having a side rotatably supported by a spindle 38 and the other side being displaced upward by the pressure of the flexible seal 37 bowing upward. The flexible seal 37 is made of, e.g., a silicone rubber. In the body case 2, a sensor such as a photointerruptor (not shown) which is an optical detector is located at a position detecting the end of rotating side of the movable chip 39 of the waste toner collection container 7 installed in the body case 2 when the movable chip 39 rotates upward.

The sensor such as a photointerruptor which is an optical detector is a waste toner quantity detector detecting the waste toner collection container 7 is nearly full of the waste toner. The waste toner quantity in the waste toner collection container is optically and precisely detected by the sensor such as a photointerruptor, i.e., optical detectors such as transmission sensors and reflective sensors. In addition, the sensor such as a photointerruptor can combine a collection container setting detector detecting the waste toner collection container 7 is correctly installed in the body case 2.

In this constitution, when image forming operation starts, a toner image is formed on each of the photoreceptors 8, and the toner image formed on each thereof is sequentially transferred onto the intermediate transfer belt 13 to form a full-color toner image thereon. The full-color toner image formed thereon is transferred by the second transfer roller 14 onto the recording medium P, fixed by the fixer 6 and discharged onto the paper tray 21.

In this image forming operation, the toners remaining on the photoreceptor 8 and the intermediate transfer belt 13 are collected by the photoreceptor cleaner 11 and the belt cleaner 15, respectively as waste toners.

The waste toner collected by the photoreceptor cleaner 11 is placed in the container body 25 from the slot 28 through the waste toner pipe 26. The waste toner collected by the belt cleaner 15 is placed in the container body 25 from the slot 29 through the waste toner pipe 27.

The container body 25 has the two slots 28 and 29, the waste toner collected by the photoreceptor cleaner 11 is led to the slot 28 through the waste toner pipe 26 and waste toner collected by the belt cleaner 15 is led to the slot 29 through the waste toner pipe 27. Therefore, it is not necessary to combine the waste toners collected by the photoreceptor cleaner 11 and the belt cleaner 15 to lead them in the container body 25, pipings to lead the waste toner into the container body 25 can be simplified and have less curves to prevent the waste toner from blocking the pipes.

The image forming apparatus of the present invention has a collection container setting detector (an electrical detector such as a switch or an optical detector such as a photointerruptor) detecting the waste toner collection container 7 is correctly installed in the image forming apparatus, and a waste toner quantity detector detecting the waste toner collection container 7 is nearly full of the waste toner (the detector 36 and photointerruptor (not shown). Further, the image forming apparatus has a controller (not shown) including a determiner determining a quantity of the waste toner in the waste toner collection container; another determiner determining whether the waste toner collection container is properly exchanged with a vacant waste toner collection container; and a limiter limiting a printable quantity after the waste toner collection container is detected to be nearly full of the waste toner, based on the another determiner. A detection signal of the collection container setting detector is a trigger of determining a quantity of the waste toner to constantly determine a quantity of the waste toner since the collection container is exchanged.

When the sensor of the waste toner quantity detector detects waste toner quantity not less than a specific quantity (a waste toner quantity accumulatable since the waste toner collection container is vacant until it is detected to be nearly full of the waste toner) when the container is nearly full of the waste toner, the container is determined to be a brand-new collection container and the apparatus is stopped after the regular predetermined number of images is printed. When the sensor of the waste toner quantity detector detects waste toner quantity not greater than a specific quantity, the container is determined to be a used collection container and the apparatus is stopped after less than the regular predetermined number of images is printed. Thus, whether the waste toner collection container is brand-new can be automatically determined without another detector. Even when the waste toner collection container is a reused container (used container previously including a waste toner) after exchanged, it is controlled to prevent the waste toner from overflowing from the container and damaging the apparatus.

The controller (not shown) of the image forming apparatus combines a controller controlling the waste toner collector and includes a central processing unit (CPU); recorders storing various control programs and data (various memories such as ROM, RAM, nonvolatile RAM and flash memories); various control circuits; various counters such as a clock, a timer and a counter; integrator of pixel information; an input and output interface; ports (I/F and I/O); etc. The CPU includes the waste toner quantity determiner, the determiner and the limiter, and controls the waste toner collector and image forming operation based on detected signals from the collection container setting detector and the waste toner quantity detector.

Figure 5:
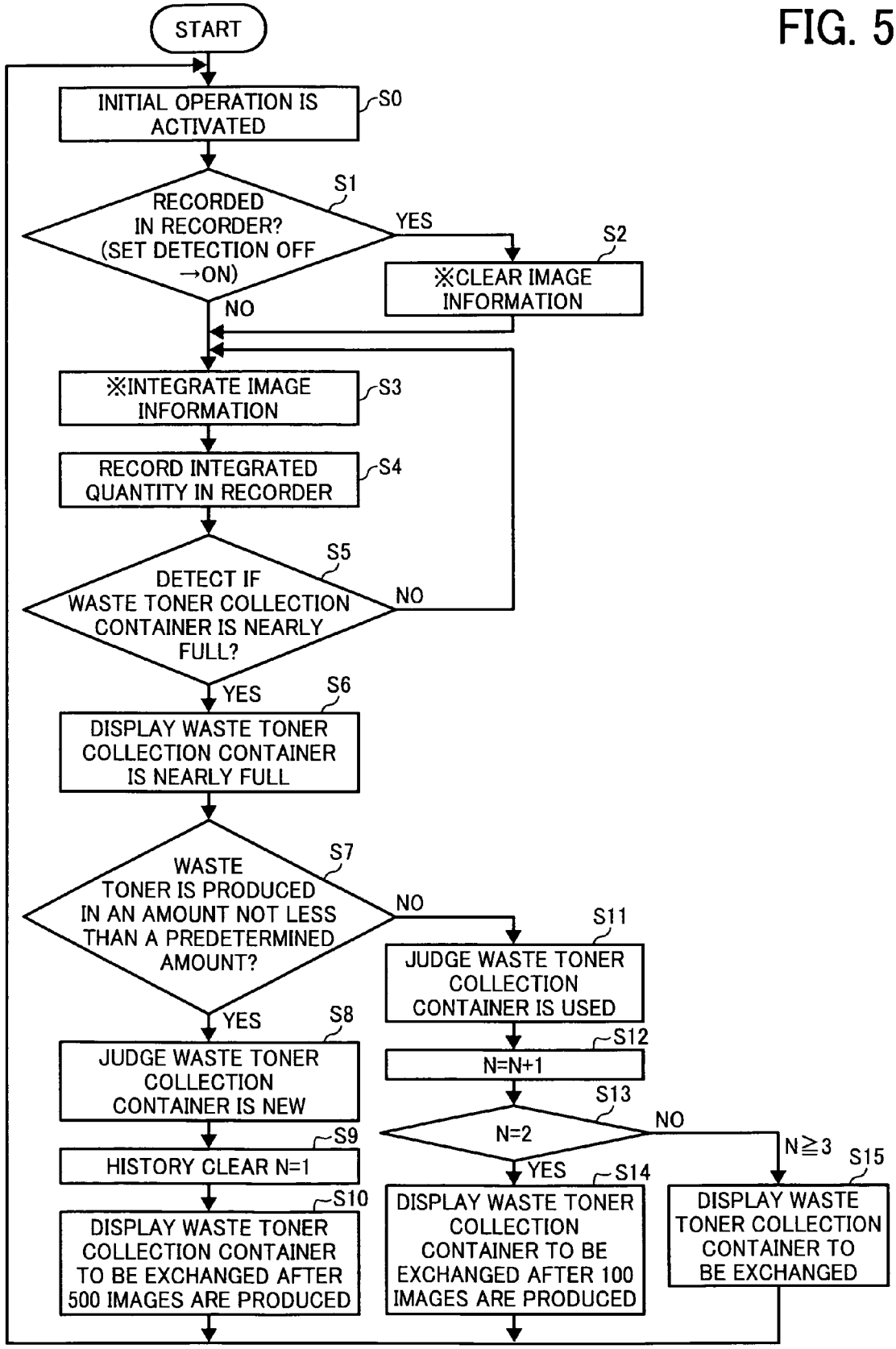
FIG. 5 is a flow chart for explaining an embodiment of an operation in the image forming apparatus (color printer) in FIG. 1.

FIG. 5 is a flow chart for explaining an embodiment of the operation of the controller.

In FIG. 5, a signal when the apparatus is turned on or the cover 24 is opened/closed causes an initial operation, i.e., step 0 (S0). During the initial operation, the CPU searches the recorded contents such as a detection of setting and pixel integration information in the recorders, i.e., memories such as ROM and RAM.

When the sensor detects the container is nearly full of a waste toner (S5), an operation panel (not shown), etc. displays that the waste toner bottle is nearly full of the waste toner (S6).

When the sensor detects the container is not nearly full of a waste toner (S5), the regular image forming operation is performed (S3). When the sensor detects the container is nearly full of a waste toner (S5), an operation panel (not shown), etc. displays that the waste toner bottle is nearly full of the waste toner (S6). Even while it is displayed that the waste toner bottle is nearly full (S5), the image forming operation is performable until the waste toner collection container becomes full.

After S6, the integrated waste toner quantity based on the pixel information is compared with a predetermined quantity (a waste toner quantity accumulatable since the waste toner collection container is vacant until it is detected to be nearly full of the waste toner) (S7). When the integrated waste toner quantity is larger than the predetermined quantity, the waste toner collection container is determined to be brand-new (S8). Then, 500 more images are printable and an operation panel, etc, displays that the waste toner collection container is full after 500 images are printed (S0). Then, a history clear process is performed, e.g., N=1 (S9). When the integrated waste toner quantity is smaller than the predetermined quantity, the waste toner collection container is determined to be used (reused) (S11) Then, 1 is added to N (S12), according to this N, it is instructed that the waste toner collection container should be exchanged after 100 images are printed when N is 2 (S13 and S14). When N is 3 or more, it is displayed that the waste toner collection container should be exchanged without printing images (S15).

Since the numbers of determinations and printable images vary according to models having different image forming functions, transferability and the capacity of the waste toner collection container, they need setting according the models (variable). Thus, when the waste toner collection container is reused after near-end, the number of printable images is gradually decreased to prevent the waste toner from filling the waste toner collection container more than the limit, overflowing therefrom and contaminating the inside and periphery of the apparatus.

The waste toner collector of the present invention including a waste toner quantity determiner determining a quantity of the waste toner in the waste toner collection container, and a determiner determining whether the waste toner collection container is properly exchanged with a vacant waste toner collection container can determine whether the waste toner collection container is properly exchanged with a vacant (brand-new) waste toner collection container and prevent the waste toner from overflowing and damaging the machine when a used waste toner collection container (previously including a waste toner).

The image forming apparatus of the present invention, including the waste toner collector; a waste toner quantity determiner determining a quantity of the waste toner in the waste toner collection container; a determiner determining whether the waste toner collection container is properly exchanged with a vacant waste toner collection container; and a limiter limiting a printable quantity after the waste toner collection container is detected to be nearly full of the waste toner, based on the determiner can determine whether the waste toner collection container is properly exchanged with a vacant (brand-new) waste toner collection container and reliably prevent the waste toner from overflowing and damaging the machine when a used waste toner collection container (previously including a waste toner) because of being capable of limiting a printable quantity after the waste toner collection container is detected to be nearly full of the waste toner, based on the another determiner.

Further, in the image forming apparatus of the present invention, in addition to the above-mentioned constitution and effects, the limiter simply determines the number of printable images after the waste toner collection container is detected to be nearly full of a waste toner is the number of printable actual recording medium to do a simple control.

In addition, in the image forming apparatus of the present invention, in addition to the above-mentioned constitution and effects, the determiner determining the collection container is exchanged with a brand-new collection container when the waste toner quantity determined by the waste toner quantity determiner is not less than a predetermined quantity when the container is nearly full can precisely determine whether the exchanged waste toner collection container is brand-new. Further, the determiner can determine that a used collection container is used when the waste toner quantity when the container is nearly full is less than a quantity accumulatable since the waste toner collection container is vacant until it is detected to be nearly full of the waste toner (predetermined quantity).

Further, in the image forming apparatus of the present invention, in addition to the above-mentioned constitution and effects, the limiter includes a print permitter permitting formation of the predetermined number of images after the waste toner collection container is detected to be nearly full of the waste toner. When the determiner determines the waste toner collection container is properly exchanged with a vacant collection container, the limiter permits formation of the regular predetermined number of images since the waste toner collection container is nearly full. When the determiner determines the waste toner collection container is a used collection container previously including a waste toner, the limiter permits formation of less than the regular predetermined number of images. The number of printable images is changed according to the collection container (brand-new or used) to prevent the machine from being broken due to formation of images after the capacity of the waste toner collection container reaches a limit.

Further, in the image forming apparatus of the present invention, in addition to the above-mentioned constitution and effects, the limiter determines the number of printable images based on the number of exchanging the waste toner collection container after detected to be nearly full of the waste toner. The limiter determines the number of printable images less based on the number of exchanging the waste toner collection container to prevent the machine from being broken due to formation of images after the capacity of the waste toner collection container reaches a limit.

Further, in the image forming apparatus of the present invention, in addition to the above-mentioned constitution and effects, the waste toner quantity determiner determining the waste toner quantity based on pixel information of a toner image such as an image area ratio, a color ratio, a toner consumption, a developer variation and a toner feed amount precisely determines a waste toner discharge quantity even when random images are produced.

Further, in the image forming apparatus of the present invention, in addition to the above-mentioned constitution and effects, the limiter prohibits the image former from forming images when printed images reach a predetermined quantity. The limiter stops image formation after the predetermined number of images are produced to prevent the machine from being broken due to formation of images after the waste toner collection container is filled with a waste toner by 100%.

Further, in the image forming apparatus of the present invention, in addition to the above-mentioned constitution and effects, the limiter simply determines the number of printable images after the waste toner collection container is detected to be nearly full of a waste toner is the number of printable actual recoding medium to do a simple control.

Further, in the image forming apparatus of the present invention, in addition to the above-mentioned constitution and effects, the limiter determines the number of printable images after the waste toner collection container is detected to be nearly full of a waste toner based on pixel information of a toner image to determine a more practical waste toner quantity.

Further, in the image forming apparatus of the present invention, in addition to the above-mentioned constitution and effects, the waste toner quantity detector optically detects the waste toner quantity in the waste toner collection container with a sensor such as a photointerruptor, i.e., an optical detector such as a transmission sensor and a reflective sensor to perform a precise detection.

Additional modifications and variations of the present invention are possible in light of the above teachings. It is therefore to be understood that within the scope of the appended claims the invention may be practiced other than as specifically described herein.

This document claims priority and contains subject matter related to Japanese Patent Application No. 2008-111370, filed on Apr. 22, 2008, the entire contents of which are herein incorporated by reference.

What is claimed is:

1. An image forming apparatus, comprising:

an image former configured to form a toner image on an image bearer;

a transferer configured to transfer the toner image onto a recording medium;

a cleaner configured to collect a waste toner remaining on the image bearer after transfer of the toner image;

a waste toner collection container configured to accumulate the waste toner therein;

a first detector configured to detect whether the waste toner collection container is properly set in the image forming apparatus;

a second detector configured to detect that the waste toner collection container is nearly full of the waste toner;

a first determiner configured to determine a first quantity of the waste toner in the waste toner collection container;

a second determiner configured to determine whether the waste toner collection container is properly exchanged with a vacant waste toner collection container; and a limiter configured to limit toner images to a printable quantity after the waste toner collection container is detected to be nearly full of the waste toner, based on the second determiner, wherein the second determiner determines that the waste toner collection container is exchanged with a new collection container when the first waste toner quantity determined by the first determiner is not less than a second quantity when the waste toner collection container is nearly full of the waste toner, the first determiner is configured to determine the first waste toner quantity based on a toner feed quantity as pixel information of the toner images, the first waste toner quantity being indicative of whether the waste toner collection container is vacant or already partially-filled, the limiter is configured to determine that the printable quantity of the toner images is the number of printable actual recording medium once the waste toner collection container is deemed to be already partially-filled by the first determiner, and the limiter is configured to determine the printable quantity of the toner images based on the pixel information.

2. The image forming apparatus of claim 1, wherein the first determiner starts determining the first quantity of the waste toner in the waste toner collection container with a detection signal of the first detector as a trigger.

3. The image forming apparatus of claim 1, wherein the limiter comprises a print permitter permitting formation of the printable quantity of toner images after the waste toner collection container is detected to be nearly full of the waste toner and permits formation of the printable quantity of toner images when the second determiner determines that the waste toner collection container is properly exchanged with the vacant waste toner collection container, and permits formation of less than the printable quantity of toner images when the second determiner determines that the waste toner collection container is a used collection container already including waste toner.

4. The image forming apparatus of claim 1, wherein the limiter determines the printable quantity of toner images based on whether the waste toner collection container detected to be nearly full of the waste toner is exchanged with the vacant waste toner collection container or a used collection container.

5. The image forming apparatus of claim 1, wherein the limiter prohibits the image former from forming toner images when the printable quantity is reached.

6. The image forming apparatus of claim 1, wherein the second detector optically detects the waste toner in the waste toner collection container with a sensor.

7. The image forming apparatus of claim 1, further comprising a plurality of the image formers configured to form a full-color image.

8. The image forming apparatus of claim 1, wherein the waste toner collection container comprises:

at least one slot in which the waste toner collected by the cleaner is placed;

a conveyor located at the upper side in the waste toner collection container, configured to convey the waste toner placed from the at least one slot in the longitudinal direction of the waste toner collection container; and the second detector located at the top of the waste toner collection container and formed of a member configured to detect that the waste toner collection container is nearly full of the waste toner.

9. The image forming apparatus of claim 1, wherein the pixel information is an image area ratio of the toner images.

* * * * *

UNITED STATES PATENT AND TRADEMARK OFFICE

CERTIFICATE OF CORRECTION

PATENT NO. : 8,452,199 B2
APPLICATION NO. : 12/385866
DATED : May 28, 2013
INVENTOR(S) : Kumagai It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 589 days.

Signed and Sealed this
Twenty-sixth Day of May, 2015

Michelle K. Lee

Michelle K. Lee
*Director of the United States Patent and Trademark Office*